US005320343A

United States Patent [19]

McKinney

[11] Patent Number: 5,320,343

[45] Date of Patent: Jun. 14, 1994

[54] COMBINATION BATTING PRACTICE TEE AND PITCHING TARGET

[76] Inventor: John B. McKinney, 3820 Cromwell Dr., Birmingham, Ala. 35243

[21] Appl. No.: 996,609

[22] Filed: Dec. 24, 1992

[51] Int. Cl.[5] ..... A63B 69/40

[52] U.S. Cl. ..... 273/26 R

[58] Field of Search ..... 273/26 R, 29 A

[56] References Cited

U.S. PATENT DOCUMENTS

| | | | |
|---|---|---|---|
| 1,888,256 | 11/1932 | Baumgarten | 273/201 |
| 3,489,411 | 1/1970 | Morelli et al. | 273/26 |
| 4,456,250 | 6/1984 | Perrone | 273/26 R |
| 4,592,545 | 6/1986 | Segedahl | 273/26 R |
| 4,664,374 | 5/1987 | Groves | 273/26 R |
| 4,664,375 | 5/1987 | Tetrault | 273/26 R |
| 4,783,070 | 11/1988 | Bauer | 273/26 R |
| 4,819,937 | 4/1989 | Gordan | 273/26 |
| 4,989,866 | 2/1991 | Dill | 273/26 |
| 5,004,234 | 4/1991 | Hollis | 273/26 |

*Primary Examiner*—Theatrice Brown
*Attorney, Agent, or Firm*—Wm. Randall May

[57] ABSTRACT

A baseball/softball practice and teaching aid apparatus which functions as a batting tee and swing corrector or as a pitching target is disclosed. A slightly modified home plate is provided with a centrally mounted and vertically adjustable post which can be rotated about its vertical axis. A vertically adjustable ball support post is attached to the centrally mounted post by an adjustable horizontal cross bar member and can be extended and retracted in a lateral direction from the centrally mounted post and can be moved in an arcuate path around the home plate and the post vertical axis. The forward corners of the plate have been removed in order that the ball support arm can be rotated into a position which allows for practice balls to be placed directly over the corners of the plate. An optional line-of-sight band is positioned between the centrally mounted post and the ball support arm to give batters swing sight guidance.

15 Claims, 2 Drawing Sheets

COMBINATION BATTING PRACTICE TEE AND PITCHING TARGET

BACKGROUND OF THE INVENTION

I. Field of the Invention

This invention relates generally to practice devices for the game of baseball and more particularly to a new and improved teaching and practice aid having a combination practice tee, swing correction device and pitching target.

II. Prior Art and Other Considerations

Adjustable posts or "tees" for mounting baseballs or softballs at various heights and plate positions for batting practice are not new in the prior art. However, while these structures, such as the ones disclosed in United States Patents to Dill, Gordon, Hollis and Morelli, et al., U.S. Pat. Nos. 4,989,866; 4,819,937; 5,004,234 and 3,489,411, respectively, have certain advantageous features in their construction and operation, all have a number of limitations and/or shortcomings which are overcome by the design and operation of the present invention.

For example, many of the conventional structures developed to date are cumbersome and are very difficult to adjust and use, especially for the younger players. Many have limited ball-strike positions and require an overly distorted or enlarged "home plate" for proper tee alignment, operation and use. Others are not designed to "teach" proper swing attitudes and ball contact strokes for hitting various types of balls such as ground balls, fly balls, line drive balls, etc. Many do not provide, or will not allow, the ball to be placed directly over the corners of the plate. Other problems include fragile, unstable design of the tee structure where a high center of gravity causes the device to be easily toppled and/or damaged during the practice operation; no rear guide or guard for line-of-sight swing guidance or device protection; complicated or intricate construction; cumbersome or difficult adjustment and operation; and protruding, potentially dangerous, hardware such as clamps, nuts, bolts and set screws.

A continuing need exists, therefore, for a new and improved batting practice, swing corrector, pitching target teaching aid which, in combination, overcomes the disabilities, deficiencies and shortcomings of the existing devices while providing for all of the advantages.

SUMMARY OF THE INVENTION

In view of the foregoing, it is a primary object of this invention to provide a new and improved apparatus for a combination batting practice tee, swing corrector and pitching target teaching aid for the game of baseball or softball which has virtually unlimited and uninhibited ball-strike positions and which is designed to teach, and allow the practice of, proper swing techniques and angles.

An advantage of the present invention is the provision of a versatile, durable and extremely effective apparatus for teaching proper hitting techniques and for practice of same.

An advantage of the present invention is the provision of a combination batting tee, swing corrector and pitching target apparatus which includes an adjustable guide post for assisting or teaching the batter to swing according to a desired angle or technique.

Another advantage of the present invention is the provision of a combination batting tee, swing corrector and pitching target apparatus which provides for line-of-sight swing adjustments.

Another advantage of the present invention is the provision of a combination batting tee, swing corrector and pitching target apparatus which is quick to assemble and disassemble, easy to adjust and simple to Still another advantage of the present invention is the provision of a combination batting tee, swing corrector and pitching target apparatus which allows the practice ball to be placed directly over the corners of the plate.

A further advantage of the present invention is the provision of a combination batting tee, swing corrector and pitching target apparatus which is very stable and has a low center of gravity in order to prevent toppling.

A further advantage of the present invention is the provision of a combination batting tee, swing corrector and pitching target apparatus which has a small number of parts and is not prone to damage during use.

According to an embodiment of the invention, a combination batting tee, swing corrector and pitching target device comprises a heavy duty, slightly modified home plate; a pivoting, vertical, telescoping guide/guard member; an optional line-of-sight band; a rigid, adjustable, horizontal cross bar member and a vertical, telescoping ball support member. The telescoping guide/guard member is pivotally, and substantially centrally, mounted to the modified home plate. Said guide/guard member is telescopically adjustable to various heights for guidance and correction of batter swing and provides support and alignment for the line-of-sight band. The guide/guard member also provides protection for the ball support member. The horizontal cross bar member is extendably attached to and between the guide/guard member and the ball support member at the lower ends thereof and provides for angular positioning of the ball support member relative to home plate.

As a batting tee and swing corrector, the ball support member is rotated to an appropriate position around the plate and is adjusted to an appropriate ball height for practice hitting. The guide/guard member is then vertically adjusted for the appropriate or desired swing attitude which the batter (or coach) desires. The line-of-sight band, if desired, is then positioned between the ball support arm and the guide/guard arm for swing sight guidance. A ball is then placed on the ball support member and practice is commenced.

As a batting tee and swing corrector for the game of slow-pitch softball, wherein the pitcher is always attempting to arch the ball so that the ball approaches the middle of the plate from a descending attitude, the ball is mounted in the middle of the plate on the guide/guard member and the ball support member is rotated to the rear-center of the plate. In this configuration, the roles of the guide/guard member and the ball support member are reversed and the ball support member, now positioned at the rear-center of the plate, is adjusted to cause or force the batter to swing at an upward angle to simulate the descending arc of a slow-pitch softball.

As a pitching target, the ball support member and the guide/guard member are extended to equal heights and the ball support member is positioned to either side of the plate depending on the type of pitch or pitches the pitcher desires to throw and the target size or strike zone desired. The strike zone can be further defined by the addition of the line-of-sight band to the ball support member and the guide/guard member.

BRIEF DESCRIPTION OF THE DRAWINGS

The foregoing and other objects, features, and advantages of the present invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

DETAILED DESCRIPTION OF THE DRAWINGS

Figure 1:
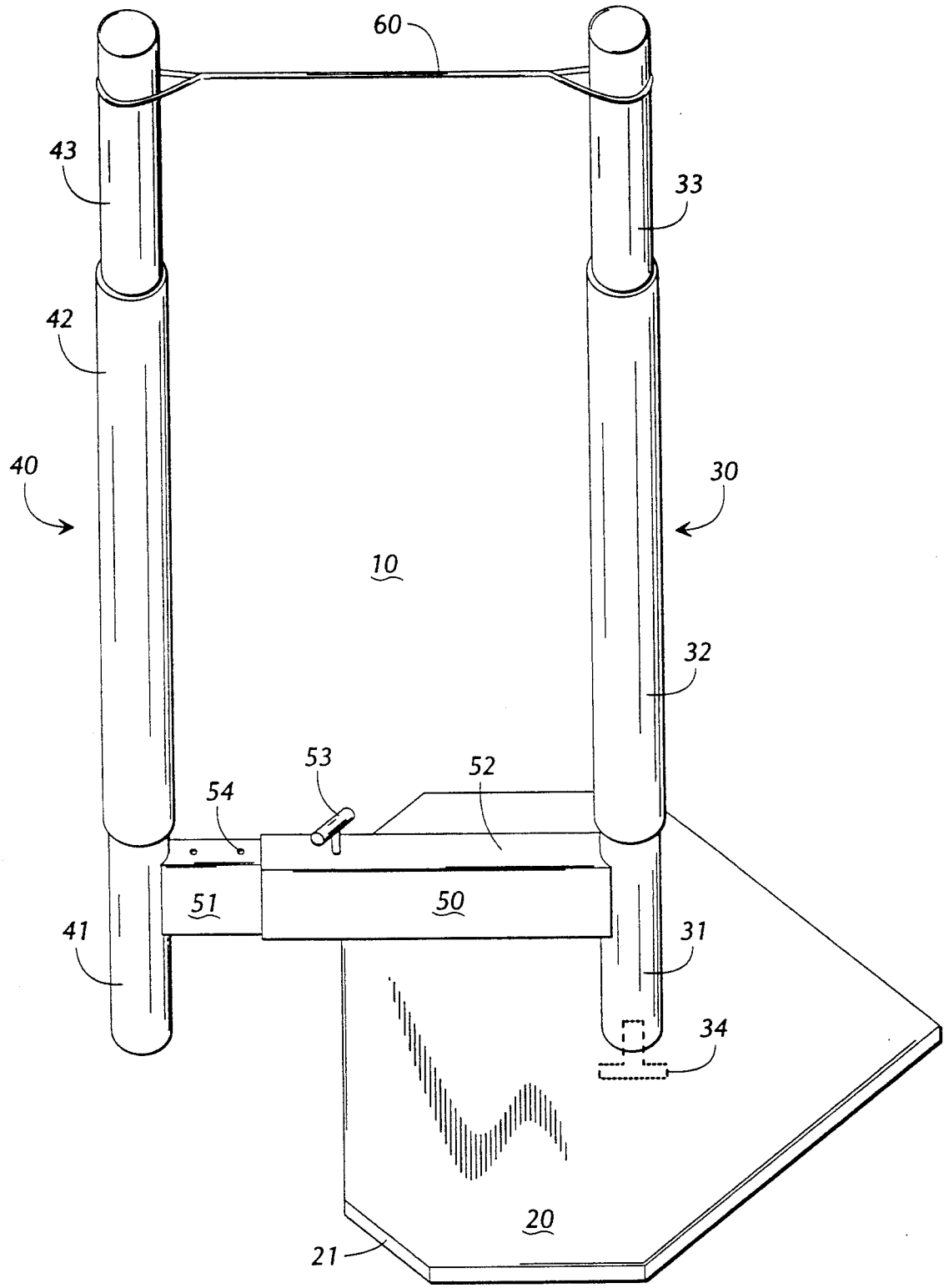
FIG. 1 is a perspective view of an embodiment of the invention.
Figure 2:
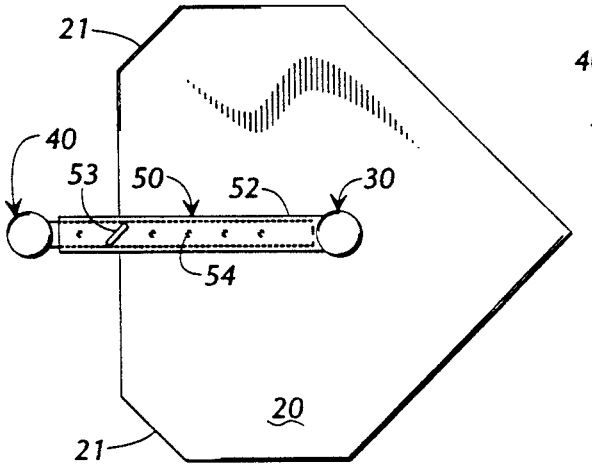
FIG. 2 is a plan view of the embodiment of FIG. 1 showing the ball support member positioned in the middle of the plate.
Figure 3:
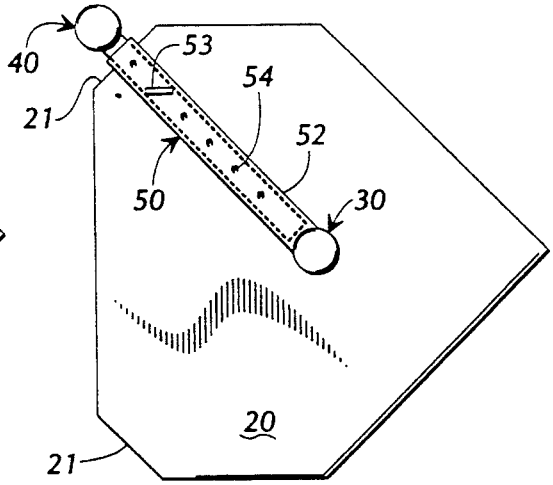
FIG. 3 is a plan view of the embodiment of FIG. 1 shown showing the ball support member positioned on the outside corner of the plate with respect to a right-handed batter.
Figure 4:
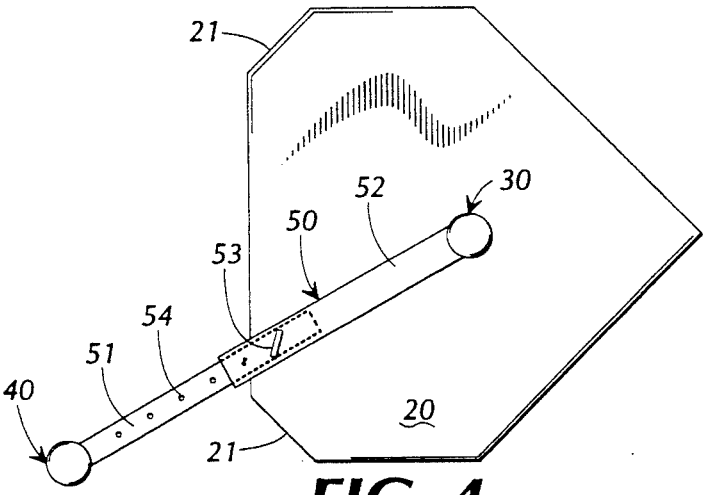
FIG. 4 is a plan view of the embodiment of FIG. 1 showing the ball support member positioned on the inside corner with respect to a right-handed batter.
Figure 5:
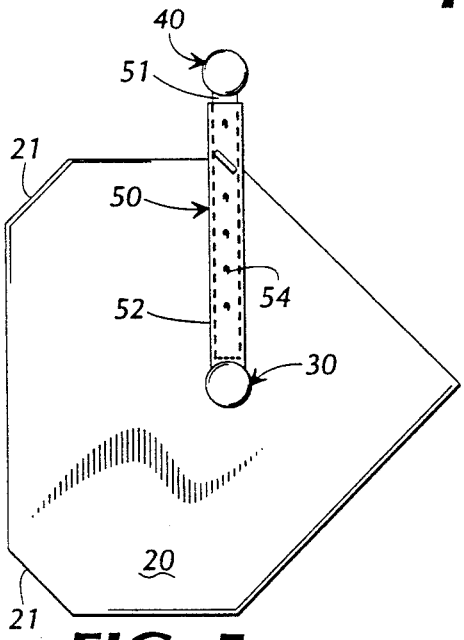
FIG. 5 is a plan view of the embodiment of FIG. 1 illustrating the use of the invention as a pitching target—right side of plate.
Figure 6:
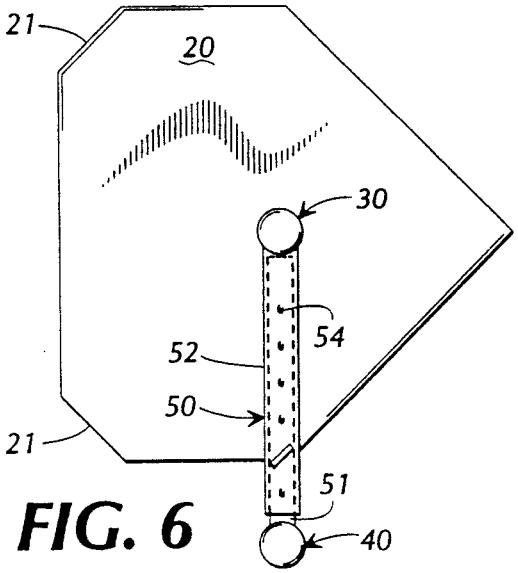
FIG. 6 is a plan view of the embodiment of FIG. 1 illustrating the use of the invention as a pitching target—left side of plate.

FIG. 1 shows a combination batting tee, swing corrector and pitching target teaching aid 10 according to an embodiment of the invention. The teaching aid 10 comprises a modified home plate 20, a pivoting or rotating guide/guard member 30, a ball support member 40, a horizontal cross bar member 50 and an optional line-of-sight swing guidance band 60.

The modified home plate 20 is a regulation size home plate, for either baseball or softball, which has been slightly modified by the removal of a small portion of its forward corners 21. Such modification of the plate 20 allows the ball support member 40 to be positioned directly over each corner 21 of plate 20. The plate 20 is constructed of heavy resilient material such as heavy rubber.

The guide/guard member 30, is tubular in overall construction and is comprised of a rigid, preferably heavy metallic, base post section 31; a flexible, resilient, preferably rubberized, middle post section 32; and a flexible, resilient, preferably rubberized, telescoping section 33. The guide/guard member 30 is vertically and rotatably mounted to the plate 20 by a securing means 34 which provides for the secure attachment of the guide/guard member 30 to the place 20 while allowing for the free rotation of said guide/guard member 30 with respect to said plate 20. In a preferred embodiment, the securing means 34 is comprised of a standard bolt and washer which are threadably secured through the plate 20 into female threads (not shown) provided at the lower end of the guide/guard member 30. The middle post section 32 of guide/guard member 30 is securely and frictionally mounted to the upper end of the base post section 31 of said guide/guard member 30. The telescoping section 33 of guide/guard member 30 is adjustably and frictionally mounted to the middle post section 32 of said guide/guard member 30 and can be vertically adjusted with respect to said middle post section 31.

The ball support member 40 is essentially identical to the construction of the guide/guard member 30 and comprises a base post section 41, a middle post section 42, and a telescoping ball support section 43. The ball support member 40 is adjustably attached to the guide/guard member 30 through the horizontal cross bar member 50. The ball support section 43 of ball support member 40 is open at its upper end and is of sufficient diameter to receive support a baseball or softball mounted thereon.

The horizontal cross bar member 50 is square or rectangular in overall shape and is constructed of rigid material, preferably heavy metal such as steel tubing or the like. Said cross bar member 50 is comprised of a male section 51 and a female section 52, which slidably engage each other, and an adjustment securing pin 53 for holding or securing the respective positions of said male and female sections 51 & 52. The male section 51 of cross bar member 50 is provided with adjustment holes or indentations 54 for seating or receiving the securing pin 53. The securing pin 53 is rectractably mounted to the female section 52 of cross bar member 50. Said female section 52 is securely and rigidly attached to the base post section 31 of guide/guard member 30 and the male section is securely and rigidly attached to the base post section 41 of ball support member 40. Together, the male section 51 and the female section 52 of cross bar member 50 slidably extend between said base post sections 31 & 41. The sliding engagement of said male and female sections 51 & 52 thus allows for the lateral extension and retraction of the ball support member 40 with respect to guide/guard member 30 and plate 20. The rotating movement of the guide/guard member 30 allows for arcuate movement of the cross bar member 50 and thus provides arcuate movement of the ball support member 40 with respect to plate 20.

The rectangular or square structure of the cross bar member 50 provides additional strength and overall support to the teaching aid 10 and prevents or resists the torquing effect experienced by the ball support member 40 when a batter unintentionally strikes said member 40 when attempting to hit a practice ball. The attachment of the male section 51 of cross bar member 50 to the base post section 41 of ball support member 40 is such that said base post section 41 is allowed to extend below the upper surface of the plate 20 to a point equivalent to the depth of the plate 20.

The line-of-sight band 60, as shown in FIG. 1, extends between the ball support member 40 and the guide/guard member 30 and is composed of an elastic or semi-elastic band which is of sufficient length to allow the band 60 to be looped over and around the ball support member 40 and the guide/guard member 30 as shown. The length and elasticity of the band 60 provides sufficient tension to hold the band 60 in place once the band 60 has been positioned onto and between ball support member 40 and guide/guard member 30. Placing the band 60 between the ball support member 40 and the guide/guard member 30 in such a manner provides the batter with a visual, perceptible, line of sight to follow and guide him or her as the batter is making his or her practice swings.

As a batting tee and swing corrector, the ball support member 40 of teaching aid 10 is rotated to an appropriate position around the plate 20 and the telescoping section 43 of ball support member 40 is adjusted to an appropriate ball height for practice hitting. The guide/-guard member 30 is then vertically adjusted for the appropriate or desired swing angle or attitude which the batter (or coach) desires. The line-of-sight band 60, if needed or desired, is then positioned between the ball support member 40 and the guide/guard member 30 for swing sight guidance. A ball is then placed on the upper end of the telescoping section 43 of ball support member 40 and practice is commenced.

As a batting tee and swing corrector for the game of slow-pitch softball, the ball support member 40 is rotated to the rear-center of the plate 20 and is adjusted to cause, or force, the batter to swing at an upward angle or in an upward manner. The guide/guard member 30, in this configuration, is used to support the ball and is adjusted to the proper swing height for each batter and for the various types of arced pitches which are typically thrown in the game of slow-pitch softball.

As a pitching target, the ball support member 40 and guide/guard member 30 of teaching aid 10 are extended to equal heights and the ball support member 40 is positioned to either side of the plate 20 depending on the type of pitch or pitches the pitcher desires to throw and the size or strike zone desired. For more defined or restricted strike zone, the line-of-sight band may be positioned between the ball support member 40 and the guide/guard member 30.

The embodiments of the invention in which an exclusive property right or privilege is claimed are defined as follows:

1. A combination batting practice tee, swing corrector and pitching target teaching aid comprising:
   - a horizontally disposed regulation size, heavy rubber home plate, said home plate having a substantially planar upper surface, said home plate being slightly modified by having a small portion of its forward corners removed;
   - an extendable first vertical member rotatably having a vertical axis and being mounted at a lower end thereof to said home plate near the center of said home plate;
   - an extendable second vertical member having a vertical axis and being rigidly but adjustably connected to said first vertical member by,
     - an elongated adjustable, multisided, horizontal cross bar member having an end attached to and intermediate the ends of a respective said first and second vertical member, whereby spacing between said first and second vertical members can be varied, said bar and said second vertical member being movable rotatable-has been substituted for "which securely attaches an arcuate path as said first vertical member is manually rotated about its vertical axis, the lower end of said second vertical member extending below said upper surface of said home plate.

2. The apparatus of claim 1, wherein said apparatus further comprises an optional, elasticized, line-of-sight swing guiding band extending between said first vertical member and said second vertical member for visual guidance and direction of a batter's practice swing along chosen paths.

3. The apparatus of claim 1, wherein said extendable first vertical member and said extendable second vertical member are constructed of at least two, slidably and frictionally engaged, tubular members.

4. The apparatus of claim 1, wherein said first vertical member further comprises:
   - a base post section;
   - a middle post section; and,
   - a top telescoping section.

5. The apparatus of claim 4, wherein said base post section is constructed of a heavy rigid tubular material, and the middle post section and the top telescoping section are constructed of a flexible, resilient rubber material.

6. The apparatus of claim 1, wherein said second vertical member further comprises:
   - a base post section;
   - a middle post section; and,
   - a telescoping ball support section.

7. The apparatus of claim 6, wherein said base post section is constructed of heavy rigid tubular material, and the middle post section and the top telescoping ball support section are constructed of a flexible, resilient rubber material.

8. The apparatus of claim 1, wherein said multisided, horizontal cross bar member is of square cross section and is constructed of heavy, rigid, tubular material and further comprises a male section, a female section and an adjustment securing means.

9. The apparatus of claim 8, wherein said male section and said female section slidably engage each other and are adjustably secured by said adjustment securing means.

10. The apparatus of claim 8, wherein said female section is provided with an adjustment hole and said male section is provided with a number of adjustment holes for receiving said adjustment securing means.

11. A combination batting practice tee, swing corrector and pitching target teaching aid comprising:
   - a horizontally disposed home plate which has been, said home plate having a substantially planar upper surface and being slightly modified by having a small portion of its forward corners removed;
   - a tubular first vertical member having a vertical axis and being rotatably mounted at its lower end to said home plate near the center of said home plate, said first vertical member comprising:
     - a base post section;
     - a tubular middle post section having a lower end telescopically receiving said base post section; and,
   - a top section telescopically received in the upper end of said middle post section; a tubular second vertical member comprising:
   - a base post section;
   - a tubular middle post section having a lower end telescopically receiving said base post section; and,
   - a telescoping ball support section telescopically received in the upper end of said middle post section, the lower end of said second vertical member extending below said upper section of said home plate; an adjustable horizontal cross bar member having an end attached to and intermediate the ends of a respective said first and second vertical member, whereby spacing between said first and second vertical members can be varied, said cross bar and said second vertical member being manually rotatable in an arcuate path about the vertical axis of said first vertical member; the lower end of said second vertical member extending below said upper surface of said home plate;

attachment means for rotatably attaching said first vertical member to said home plate; and, an optional line-of-sight swing guiding band extending between said first vertical member and said second vertical member.

12. The apparatus of claim 11, wherein said base post sections of said first vertical member and said second vertical member are constructed of heavy rigid material such as tubular steel.

13. The apparatus of claim 11, wherein said middle post sections of said first vertical member and said second vertical member are constructed of a flexible, resilient rubber material.

14. The apparatus of claim 11, wherein said telescoping guide/guard section and said telescoping ball support member of said first and second vertical members, respectively, are constructed of a flexible, resilient rubber material.

15. The apparatus of claim 11, wherein said horizontal cross bar member is of multisided cross section and is constructed of heavy, rigid, tubular material.

* * * * *